US007658640B2

(12) United States Patent
Nakazawa et al.

(10) Patent No.: US 7,658,640 B2
(45) Date of Patent: Feb. 9, 2010

(54) CABLE CONNECTOR, METHOD OF CONNECTING A CABLE CONNECTOR AND A CABLE

(75) Inventors: Katsuhiko Nakazawa, Tokyo (JP); Masahiro Yamauchi, Tokyo (JP)

(73) Assignees: Japan Aviation Electronics Industry, Limited, Tokyo (JP); NEC Corporation, Tokyo (JP)

( * ) Notice: Subject to any disclaimer, the term of this patent is extended or adjusted under 35 U.S.C. 154(b) by 0 days.

(21) Appl. No.: 12/220,048

(22) Filed: Jul. 21, 2008

(65) Prior Publication Data

US 2009/0081901 A1 Mar. 26, 2009

(30) Foreign Application Priority Data

Sep. 21, 2007 (JP) ..... 2007-245484

(51) Int. Cl.
*H01R 12/24* (2006.01)

(52) U.S. Cl. ..... 439/498; 439/496

(58) Field of Classification Search ..... 439/498, 439/496, 499, 494, 492; 29/857
See application file for complete search history.

(56) References Cited

U.S. PATENT DOCUMENTS 4,973,264 A * 11/1990 Kamono et al. ..... 439/498
6,210,174 B1 * 4/2001 Pei et al. ..... 439/67
6,817,892 B2 * 11/2004 Sakai et al. ..... 439/495
6,860,755 B2 * 3/2005 Wang et al. ..... 439/498
7,070,444 B2 * 7/2006 Sato et al. ..... 439/496
7,275,955 B2 * 10/2007 Ko ..... 439/498

FOREIGN PATENT DOCUMENTS

| | | |
|---|---|---|
| JP | 62-055878 | 3/1987 |
| JP | 07-211405 | 8/1995 |
| JP | 2002-075537 | 3/2002 |
| JP | 2002-260804 | 9/2002 |
| JP | 2004-192817 | 7/2004 |

OTHER PUBLICATIONS

Japanese Office Action dated Sep. 9, 2009.

* cited by examiner

*Primary Examiner*—Hien Vu
(74) *Attorney, Agent, or Firm*—Collard & Roe, P.C.

(57) ABSTRACT

A cable connector 1 includes a cover insulator adapted to clamp a cable. The cable has an end portion bent by a bending angle α. The cover insulator is coupled to a base insulator. The base insulator holds a terminal having an end portion bent by a bending angle β. Herein, the angles α and β satisfy the relationship given by $\beta<\pi-\alpha$ (rad) so that the end portion of the cable is pressed by the end portion of the terminal.

5 Claims, 11 Drawing Sheets

CABLE CONNECTOR, METHOD OF CONNECTING A CABLE CONNECTOR AND A CABLE

This application is based upon and claims the benefit of priority from Japanese patent application No. 2007-245484, filed on Sep. 21, 2007, the disclosure of which is incorporated herein in its entirety by reference.

BACKGROUND OF THE INVENTION

The present invention relates to a cable connector and a method of connecting a cable connector and a cable.

For installation of electrical equipment in transport machines such as automobiles, computer wiring, and the like, cables having a variety of structures are used. Generally, cable connectors for connection between cables are provided.

For example, a cable connector comprises a cover insulator adapted to clamp an end portion of a cable and a base insulator having a terminal (contact) to be connected to another connector as a mating connector.

With this structure, the cable connector and the cable are connected by coupling the cover insulator and the base insulator and connecting the end portion of the cable and the terminal of the cable connector.

As a method of connecting the end portion of the cable and the terminal of the cable connector, a connecting method using a solder is known, for example, as described in Japanese Unexamined Patent Application Publication (JP-A) No. 2004-192817 (Patent Document 1).

Specifically, as described in Patent Document 1, a central conductor (at the end portion of a cable) and the terminal are connected by the solder.

However, in the connecting method mentioned above, variation in an amount of the solder results in variation in cross sectional area of a connecting portion. In this event, impedance mismatch may be caused during high-speed transmission.

In view of the above, development is made of a connecting method using so-called laser welding. In this method, the cable is connected to the terminal by irradiating a laser beam directly to the connecting portion to melt the connecting portion.

In this case, the end portion of the cable and the terminal must be brought into tight contact with each other in advance. For this purpose, use is made of a structure in which the end portion of the cable and the terminal are pressed by an additional fixing member to be brought into tight contact with each other.

For example, Japanese Unexamined Patent Application Publication (JP-A) No. H07-211405 (Patent Document 2) discloses a connector having a structure in which a conductor at an end portion of a cable and a connecting terminal are pressed by an elastic member integrally formed with a housing portion.

SUMMARY OF THE INVENTION

However, in the above-mentioned structure, the cable connector has a complicated structure because the elastic member is required.

Furthermore, the elastic member is arranged so as to bring the cable into contact with the terminal. Thus, an irradiation direction of the laser beam is undesirably limited by the elastic member.

In view of the above-mentioned problems, it is an object of this invention to provide a cable connector in which a connecting portion has a simple structure and an irradiation direction of a laser beam is not limited.

It is also another object of this invention to provide a method of connecting a cable connector and a cable in which an irradiation direction of a laser beam is not limited.

According to the first invention, there is provided a cable connector comprising a cover insulator for holding an end portion of a cable, a base insulator coupled to the cover insulator, and a terminal held on the base insulator and adapted to be connected to another connector and the cable, the cover insulator having holding unit holding the end portion of the cable, the terminal having an end portion held in a shape adapted to press the end portion of the cable when the cover insulator and the base insulator are coupled to each other, the cable connector being connected to the cable by coupling the cover insulator and the base insulator to each other and connecting the terminal to the end portion of the cable by laser welding.

According to the second invention, there is provided a method of connecting a cable connector and a cable, the cable connector comprising a cover insulator for holding an end portion of the cable; a base insulator coupled to the cover insulator, and a terminal held on the base insulator and adapted to be connected to another connector and the cable; the method comprising, (a) bending the end portion of the cable, (b) bending an end portion of the terminal into a shape adapted to press the end portion of the cable when the cover insulator and the base insulator are coupled to each other, (c) coupling the cover insulator and the base insulator to each other; and (d) connecting the end portion of the cable and the end portion of the terminal by laser welding.

In the first and the second inventions, the cable connector comprises the cover insulator holding the cable, the base insulator to be coupled to the cover insulator, and the terminal held on the base insulator. In the cable connector, the cable and the terminal are bent by bending angles determined so that the end portion of the terminal can press the end portion of the cable when the cover insulator and the base insulator are coupled to each other.

Therefore, an additional elastic member or the like for bringing the end portion of the cable and the terminal into tight contact with each other is not required so that the cable connector has a simple structure.

Since the elastic member or the like is not required, an irradiation direction of a laser beam is not limited during laser welding.

According to the first invention, it is possible to provide a cable connector in which a connecting portion has a simple structure and an irradiation direction of a laser beam is not limited.

According to the second invention, it is possible to provide a method of connecting a cable connector and a cable in which an irradiation direction of a laser beam is not limited.

Figure 1:
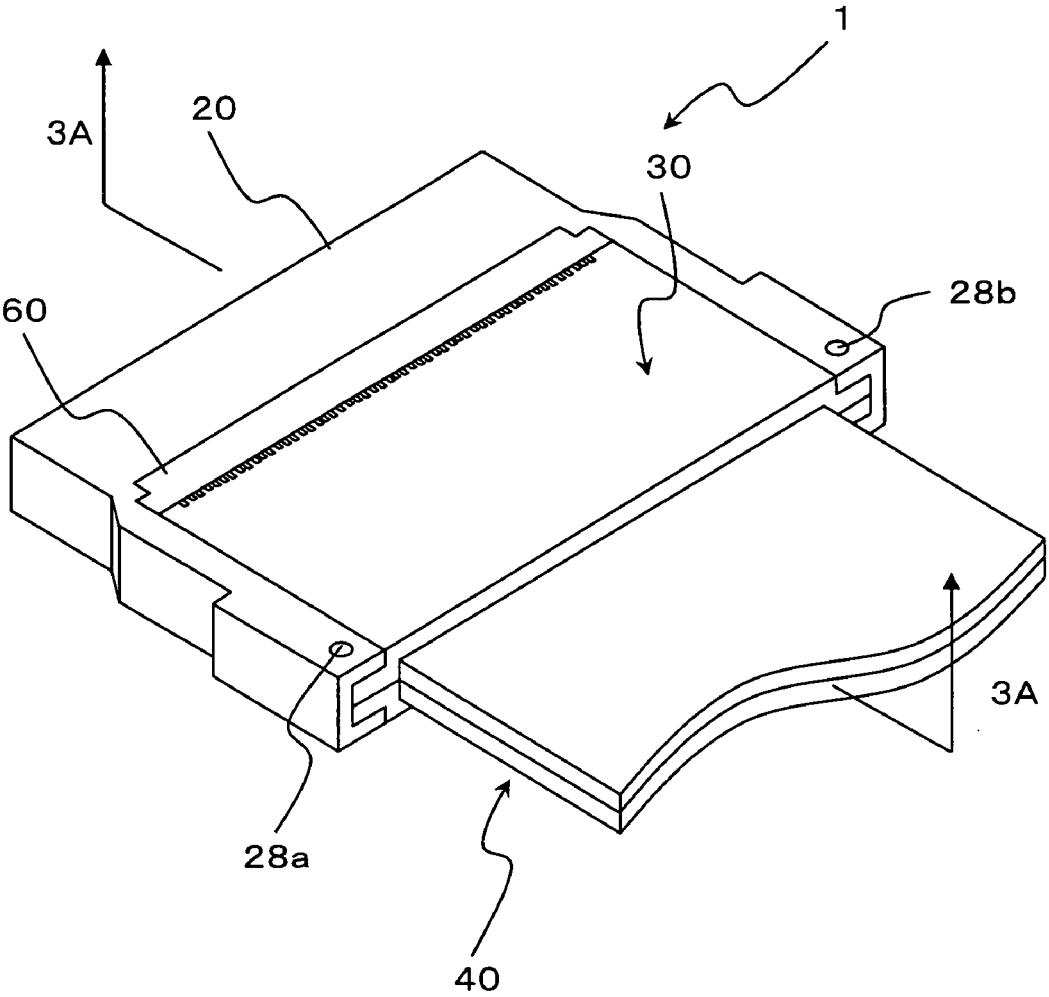
FIG. 1 is a perspective view showing a cable connector.

DESCRIPTION OF THE EXEMPLARY EMBODIMENT:

Now, an exemplary embodiment of this invention will be described in detail with reference to the drawing.

At first referring to FIGS. 1 and 2, description will be made about a schematic structure of a cable connector 1 according to this embodiment.

Herein, as the cable connector 1, a cable connector for a flat cable is illustrated by way of example.

Figure 2:
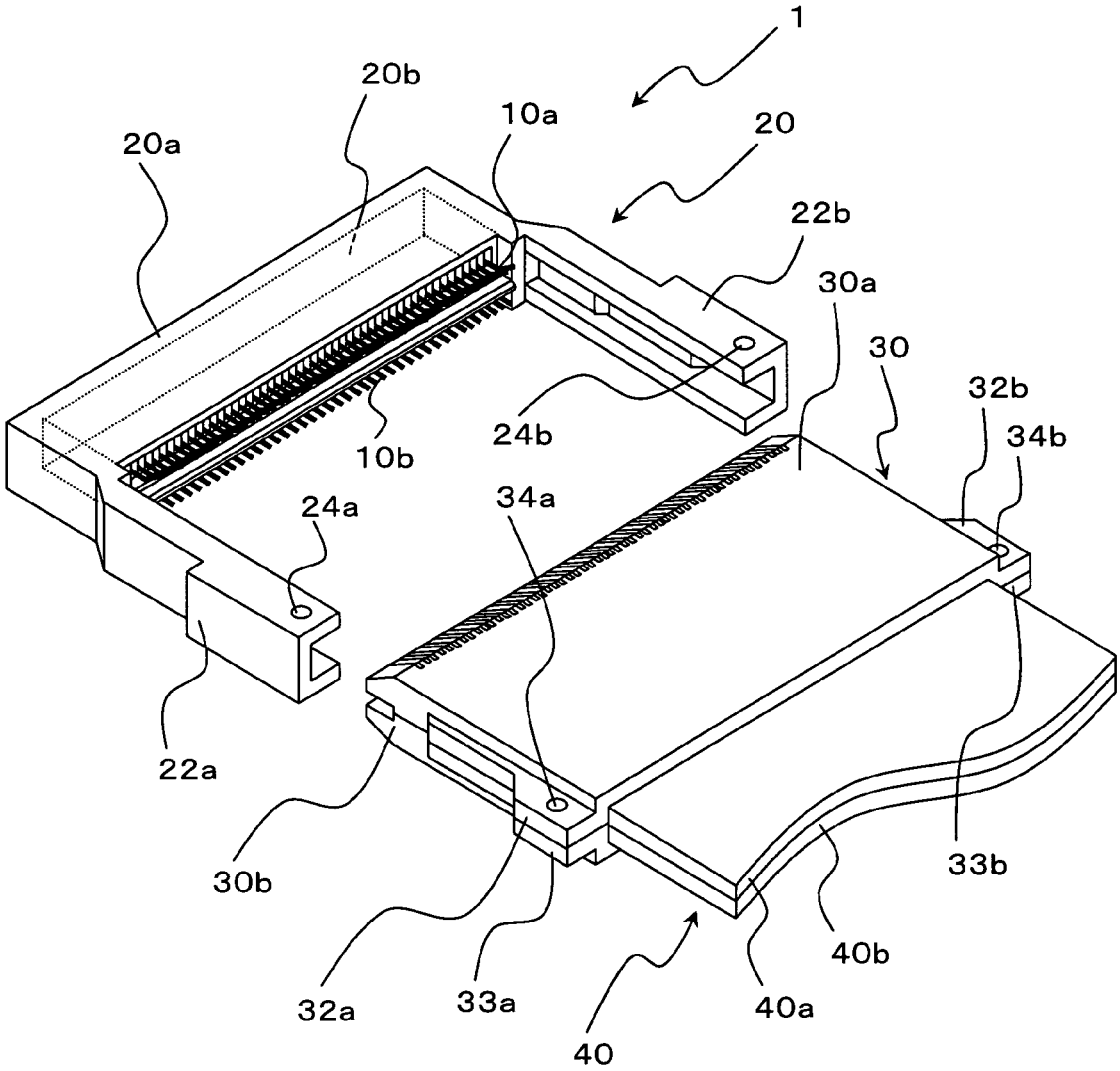
FIG. 2 is an exploded perspective view of the cable connector illustrated in FIG. 1 but without an insulating member.

As shown in FIGS. 1 and 2, the cable connector 1 comprises a cover insulator 30, a base insulator 20, and a plurality of terminals 10*a* and 10*b*.

The cover insulator 30 is adapted to clamp a cable 40. Thus, the cover insulator 30 is a member for holding an end portion of the cable 40.

The base insulator 20 is adapted to be connected to another connector as a mating connector 81. The base insulator 20 is coupled to the cover insulator 30 so as to surround the cover insulator 30. The base insulator 20 holds the terminals 10*a* and 10*b*.

An insulating member 60 is filled between the base insulator 20 and the cover insulator 30 as will later be described in detail.

Next referring to FIGS. 1 to 8, description will be made in detail about structures of the cable 40, the cover insulator 30, and the base insulator 20.

At first referring to FIGS. 2 to 4, the structure of the cable 40 will be described. As shown in FIGS. 2 to 4, the cable 40 is a so-called flat cable and comprises two cables, that is, a first cable 40*a* and a second cable 40*b*. As shown in FIG. 4, the first cable 40*a* has a plurality of conductive core wires 41*a*. Similarly, the second cable 40*b* has a plurality of conductive core wires 41*b*. The core wires 41*a* are covered with an insulation coating 42*a*. Similarly, the core wires 41*b* are covered with an insulation coating 42*b*.

As will later be described in detail, the first and the second cables 40*a* and 40*b* have end portions where the core wires 41*a* and 41*b* are exposed. The end portions (the core wires 41*a* and 41*b*) of the first and the second cables 40*a* and 40*b* are bent and held at a predetermined bending angle $\alpha$.

Next referring to FIGS. 2, 3A, 3B, and 5 to 7, the structure of the cover insulator 30 will be described.

Figure 3A:
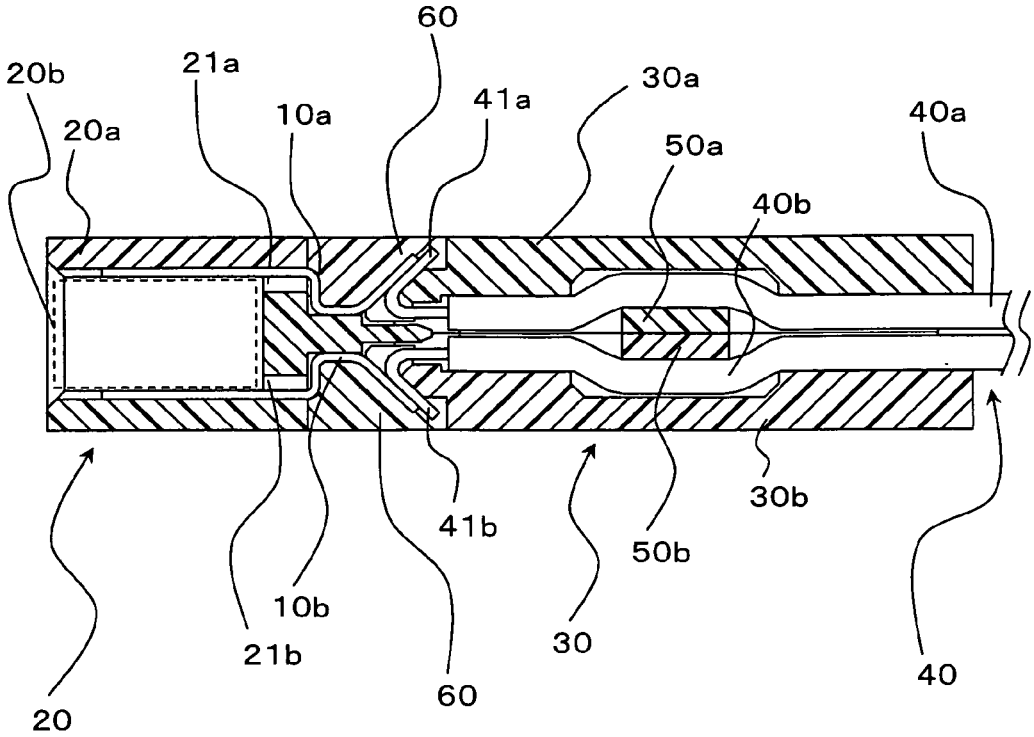
FIG. 3A is an enlarged sectional view taken along a line 3A-3A in FIG. 1, with a cable and terminals shown by a side view.
Figure 3B:
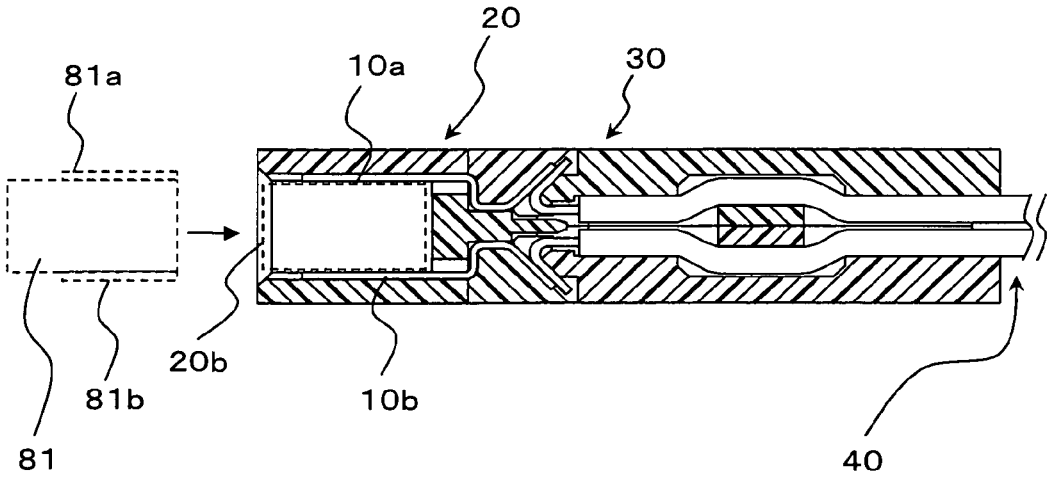
FIG. 3B is an enlarged sectional view, similar to FIG. 3A, for describing a method of connecting another connector to the cable connector.
Figure 4:
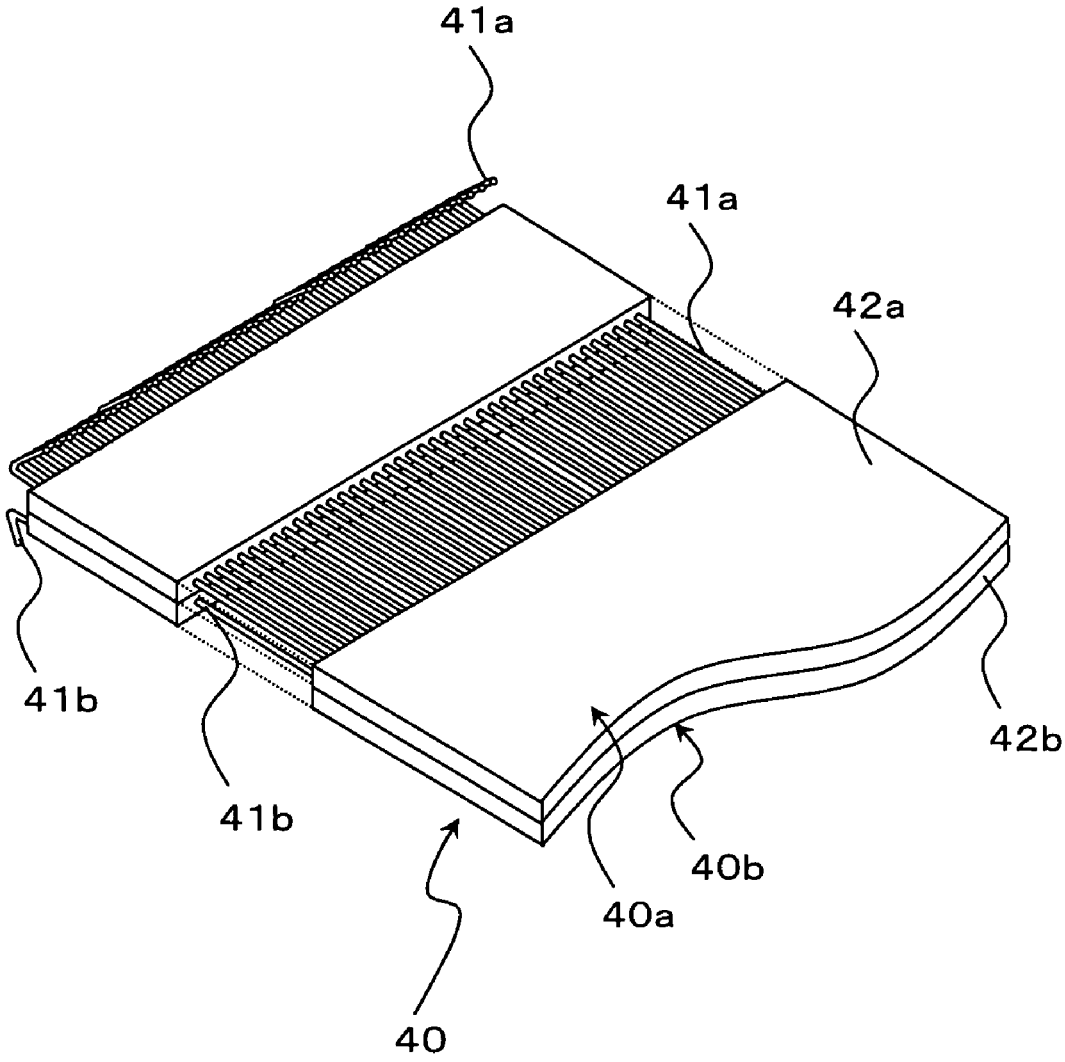
FIG. 4 is a partially-cutaway perspective view of the cable illustrated in FIG. 2.

As shown in FIGS. 2, 3A and 3B, the cover insulator 30 comprises covers 30*a* and 30*b* faced to each other so as to clamp the end portion of the cable 40.

As shown in FIG. 2, the cover 30*a* has a pair of side surfaces provided with projections 32*a* and 32*b* to be engaged with the base insulator 20 upon coupling, respectively. Similarly, the cover 30*b* has a pair of side surfaces provided with projections 33*a* and 33*b*, respectively. The projections 32*a* and 32*b* are provided with holes 34*a* and 34*b* adapted to receive pins 28*a* and 28*b* (which will later be described), respectively. When the cover insulator 30 is coupled to the base insulator 20, the pins 28*a* and 28*b* are press-fitted into the holes 34*a* and 34*b* to fix the cover insulator 30 and the base insulator 20 to each other. Although not illustrated in the figure, the projections 33*a* and 33*b* are provided with similar holes 35*a* and 35*b*. The covers 30*a* and 30*b* are arranged in the manner such that the holes 34*a* and 35*a* are overlapped with each other and that the holes 34*b* and 35*b* are overlapped with each other.

As shown in FIG. 3A, the cover 30*a* has a plate-like clamp 50*a* faced to an inner surface thereof which is in contact with the first cable 40*a*. The cover 30*a* and the clamp 50*a* clamp the end portion of the first cable 40*a* to hold the end portion of the first cable 40*a*.

Similarly, the cover 30*b* has a plate-like clamp 50*b* faced to an inner surface thereof which is in contact with the second cable 40*b*. The cover 30*b* and the clamp 50*b* clamp the end portion of the second cable 40*b* to hold the end portion of the second cable 40*b*.

Figure 6:
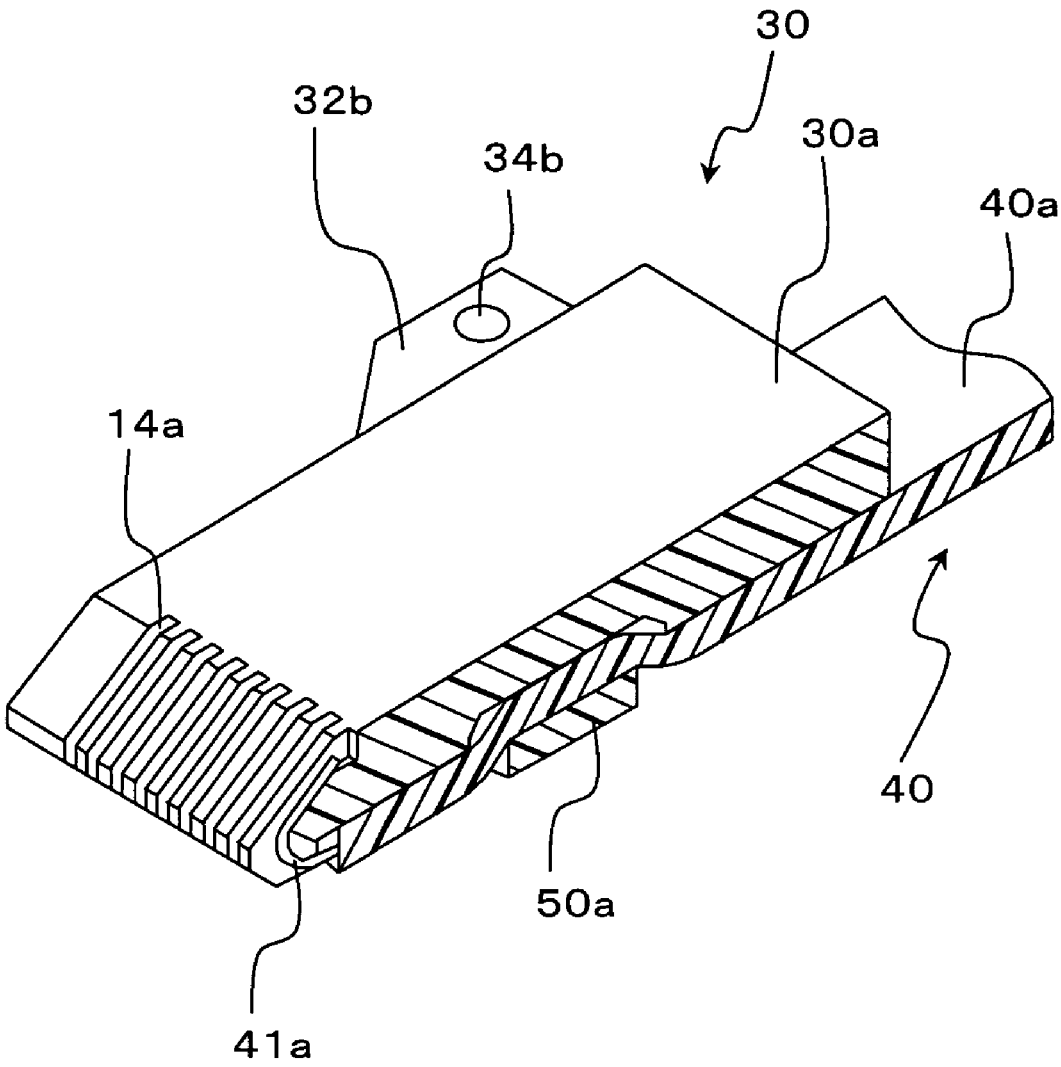
FIG. 6 is an enlarged perspective view, partially in section, of a part of a cover insulator illustrated in FIG. 2.
Figure 7:
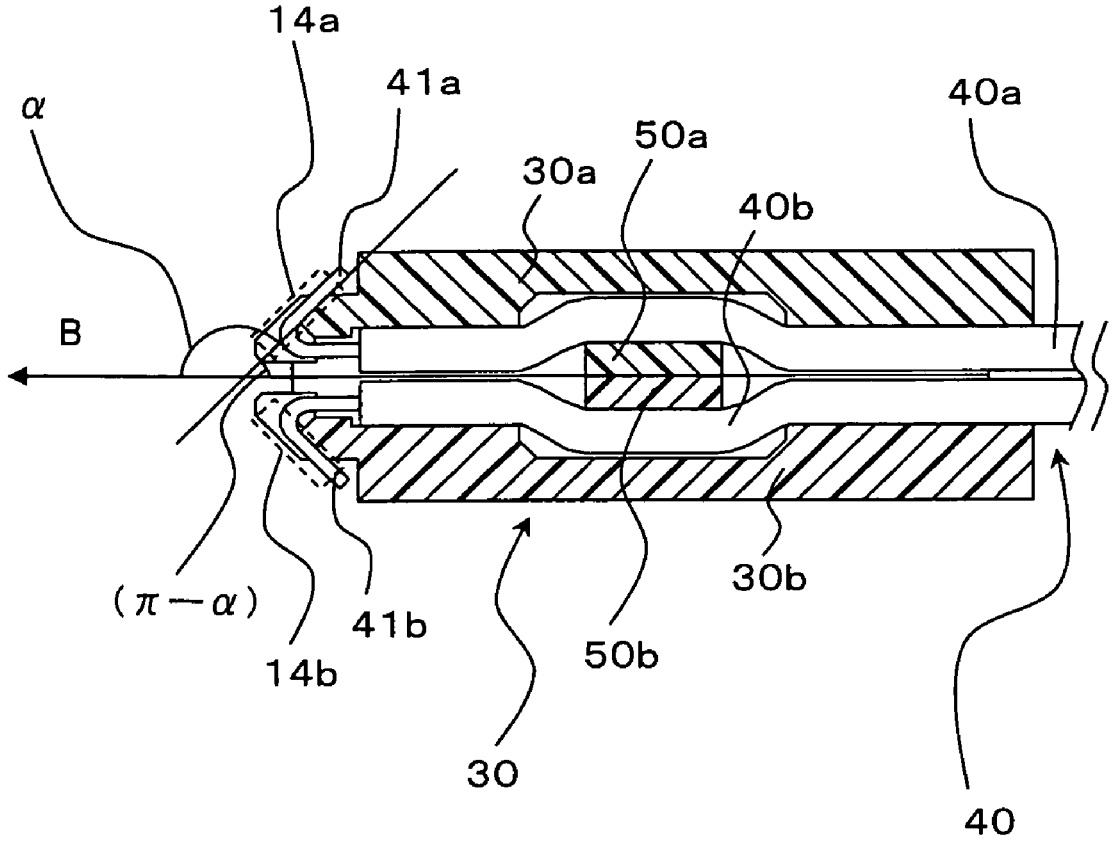
FIG. 7 is a view showing the cover insulator illustrated in FIG. 3A.

As shown in FIGS. 6 and 7, the cover 30*a* has an end portion provided with a plurality of grooves 14*a* as a holding unit. The core wires 41*a* exposed at the end portion of the first cable 40*a* are bent and inserted into the grooves 14*a*, respectively.

As shown in FIG. 7, the grooves 14*a* are inclined by an inclination angle ($\pi-\alpha$) with respect to a coupling direction B along which the cover insulator 30 and the base insulator 20 are coupled to each other. Thus, the grooves 14*a* serve to hold the core wires 41*a* bent by the predetermined bending angle $\alpha$ with respect to the coupling direction B.

As shown in FIG. 7, the cover 30*b* has an end portion provided with a plurality of grooves 14*b* as a holding unit. The grooves 14*b* correspond in shape to the core wires 41*b*.

The core wires 41*b* exposed at the end portion of the second cable 40*b* are bent and inserted into the grooves 14*b*, respectively.

The grooves 14*b* are inclined by an inclination angle ($\pi-\alpha$) with respect to the coupling direction B. Thus, the grooves 14*b* serve to hold the core wires 41*b* bent by the predetermined bending angle $\alpha$ (not shown).

Next referring to FIGS. 1, 2, 3A, 3B, and 8, the structure of the base insulator 20 will be described in detail.

As shown in FIGS. 2, 3A, 3B and 8, the base insulator 20 has a main body 20*a*. The main body 20*a* has a recessed portion 20*b* formed at its front surface on the side fitted to the mating connector 81 (which will later be described). The recessed portion 20*b* is adapted to receive the mating connecter 81 inserted therein. The main body 20*a* has a pair of U-shaped portions 22*a* and 22*b* formed at both ends of its rear surface opposite to the front surface provided with the recessed portion 20*b*. The U-shaped portions 22*a* and 22*b* are adapted to be engaged with the projections 32*a*, 32*b*, 33*a*, and 33*b* when the base insulator 20 is coupled to the cover insulator 30.

In the state illustrated in FIG. 1, the U-shaped portion 22*a* is engaged with the projections 32*a* and 33*a* while the U-shaped portion 22*b* is engaged with the projections 32*b* and 33*b*.

The U-shaped portions 22*a* and 22*b* are provided with holes 24*a* and 24*b*, respectively. The holes 24*a* and 24*b* are adapted to receive the pins 28*a* and 28*b* (which will later be described) press-fitted therein when the cover insulator 30 and the base insulator 20 are coupled to each other.

In the state illustrated FIG. 1, the pin 28*a* is press-fitted into the holes 24*a*, 34*a*, and 35*a* while the pin 28*b* is press-fitted into the holes 24*b*, 34*b*, and 35*b*. Thus, the cover insulator 30 and the base insulator 20 are fixed to each other by the pins 28*a* and 28*b*.

As shown in FIG. 3A, the main body 20*a* has an inner wall provided with a plurality of terminal holding portions 21*a* and

21*b* which penetrate through the inner wall to protrude from the rear surface opposite to the front surface provided with the recessed portion 20*b*.

The terminal holding portions 21*a* and 21*b* hold the terminals 10*a* and 10*b*, respectively. The terminals 10*a* and 10*b* are equal in number to the core wires 41*a* and 41*b*, respectively. The terminals 10*a* are connected to the core wires 41*a* and a plurality of terminals 81*a* (which will later be described) of the mating connector 81. The terminals 10*b* are connected to the core wires 41*b* and a plurality of terminals 81*b* (which will later be described) of the mating connector 81.

Figure 8:
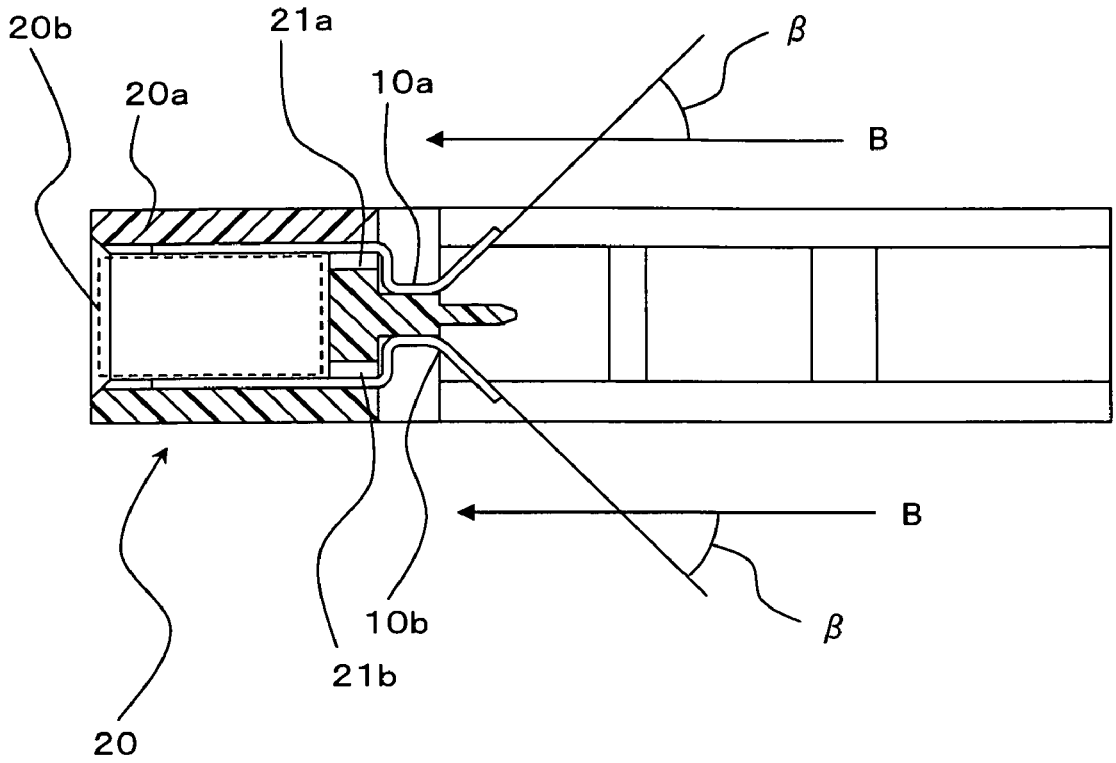
FIG. 8 is a view showing a base insulator illustrated in FIG. 3A.

As shown in FIG. 8, the terminals 10*a* and 10*b* have end portions held in a shape adapted to press the core wires 41*a* and 41*b* exposed at the end portion of the cable 40 when the cover insulator 30 and the base insulator 20 are coupled to each other.

Specifically, the end portions of the terminals 10*a* and 10*b* are bent and held at a bending angle β with respect to the coupling direction B in the state where the terminals 10*a* and 10*b* are not brought into contact with the cable 40

Herein, the angles α and β satisfy the relationship given by:

$$\beta<\pi-\alpha(\text{rad}) \quad (1)$$

By setting the angles α and β satisfying the above-mentioned relationship, the core wires 41*a* and 41*b* are pressed by the end portions of the terminals 10*a* and 10*b* when the cover insulator 30 and the base insulator 20 are coupled to each other. Therefore, the end portions of the terminals 10*a* and 10*b* come into tight contact with the core wires 41*a* and 41*b*.

Thus, in this embodiment, the end portions of the terminals 10*a* and 10*b* serve as an elastic member. Therefore, an additional elastic member or the like for bringing the end portions of the terminals and the core wires into tight contact with each other is not required.

Herein, in the cable connector 1, the end portions of the terminals 10*a* and 10*b* are connected to the core wires 41*a* and 41*b* by laser welding which will later be described. Since the elastic member or the like is not required as described above, an irradiation direction of a laser beam is not limited during laser welding.

As shown in FIG. 3A, in the cable connector 1, the end portions of the terminals 10*a* and 10*b* and the core wires 41*a* and 41*b* are covered with the insulating member 60.

Now, description will briefly be made about a method of connecting the cable 40 connected to the cable connector 1 to another cable as a mating cable or a substrate.

In case where the cable 40 connected to the cable connector 1 is electrically connected to the mating cable or the substrate, the mating connector 81 connected to the mating cable or the substrate is inserted into the recessed portion 20*b* of the base insulator 20, as shown in FIG. 3B. Then, the terminals 10*a* and 10*b* are connected to the terminals 81*a* and 81*b* of the mating connector 81. Consequently, the cable 40 is electrically connected to the mating cable or the substrate via the terminals 10*a* and 10*b* and the terminals 81*a* and 81*b* of the mating connector 81.

Next referring to FIGS. 2, 3A, 3B, 5, and 9 to 11, description will be made about a method of connecting the cable connector 1 to the cable 40.

Figure 9:
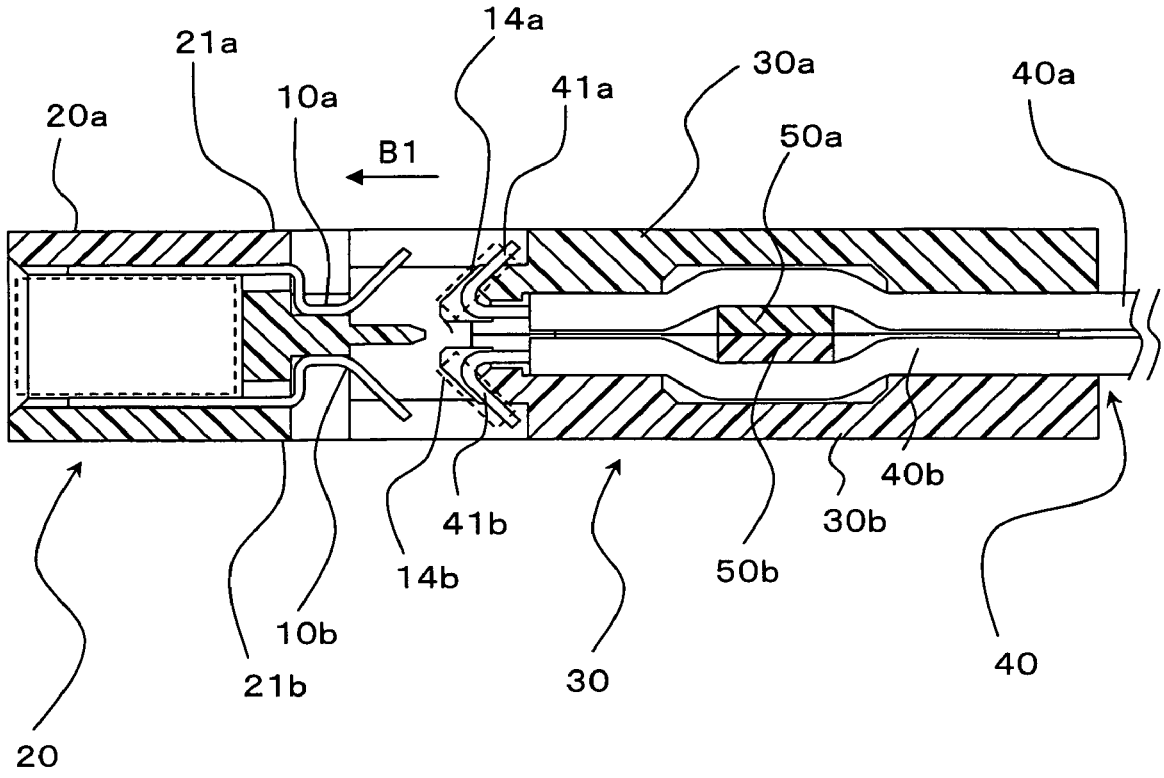
FIGS. 9 to 11 are sectional views for describing methods of connecting the cable connector and the cable to each other.

At first referring to FIG. 9, the cable 40 is combined with the cover insulator 30. Specifically, the first and the second cables 40*a* and 40*b* are combined with the covers 30*a* and 30*b*, respectively, and the core wires 41*a* and 41*b* are inserted into the grooves 14*a* and 14*b*, respectively.

By inserting the core wires 41*a* and 41*b* into the grooves 14*a* and 14*b*, the core wires 41*a* and 41*b* at the end portion of the first and the second cables 40*a* and 40*b* are bent and held at the bending angle α.

Thereafter, the covers 30*a* and 30*b* are combined with each other.

Furthermore, the terminals 10*a* and 10*b* are combined with the cover insulator 30 and the end portions of the terminals 10*a* and 10*b* are bent and held at the bending angle β.

Next, the cover insulator 30 is moved in a direction depicted by an arrow B1 in FIG. 9 and inserted into the base insulator 20.

At this time, the cover insulator 30 is inserted into the base insulator 20 in the manner such that the projections 32*a* and 33*a* and the projections 32*b* and 33*b* of the cover insulator 30 are engaged with inner walls of the U-shaped portions 22*a* and 22*b* of the base insulator 20, respectively (see FIG. 2).

By inserting the cover insulator 30 in the above-mentioned manner, the coupling direction is limited to the direction depicted by the arrow B1 in FIG. 9. Consequently, positioning is accurately carried out.

When the cover insulator 30 is moved to a position where the holes 24*a* and 24*b* of the base insulator 20 are coincident with the holes 34*a*, 34*b*, 35*a*, and 35*b* of the cover insulator 30, insertion is stopped.

Then, the pin 28*a* is press-fitted into the holes 24*a*, 34*a*, and 35*a* while the pin 28*b* is press-fitted into the holes 24*b*, 34*b*, and 35*b* so that the cover insulator 30 is fixed to the base insulator 20.

As described above, the cover insulator 30 and the base insulator 20 are coupled to each other.

Figure 10:
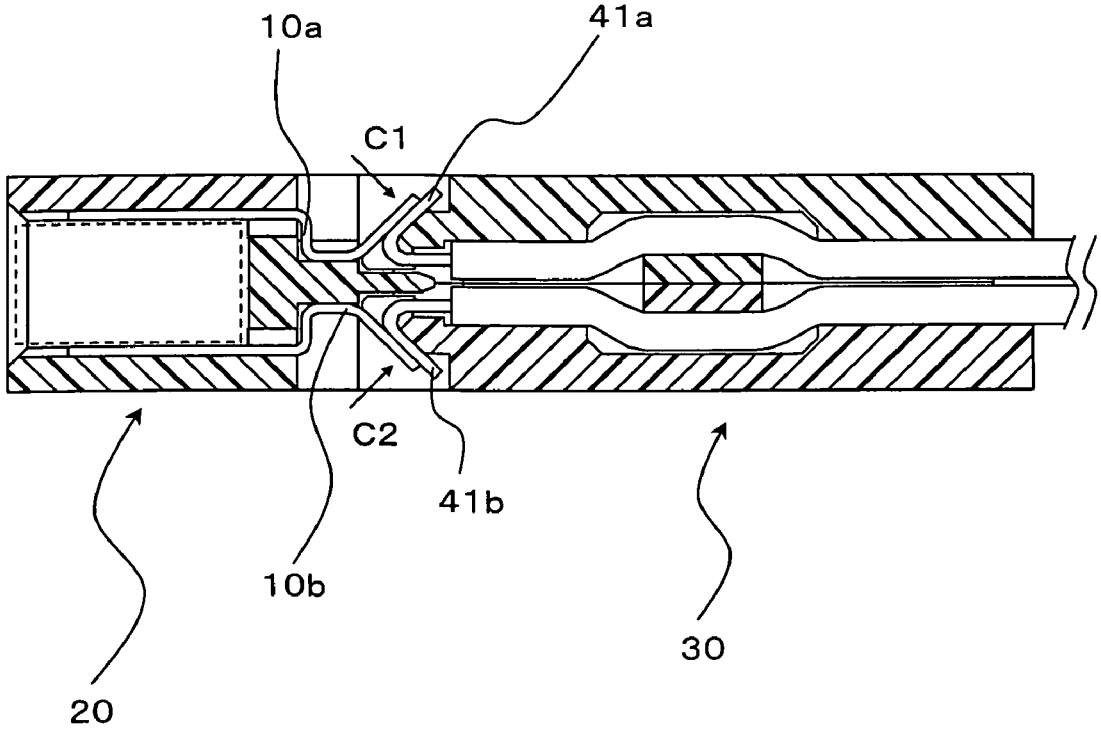

In the above-mentioned state, the end portions of the terminals 10*a* and 10*b* are brought into contact with the core wires 41*a* and 41*b*, respectively, as shown in FIG. 10. At this time, the angles α and β satisfy the relationship given by the inequality (1). Therefore, the end portions of the terminals 10*a* and 10*b* press the core wires 41*a* and 41*b* in directions depicted by arrows C1 and C2 so that the end portions of the terminals 10*a* and 10*b* are brought into tight contact with the core wires 41*a* and 41*b*, respectively.

Figure 11:
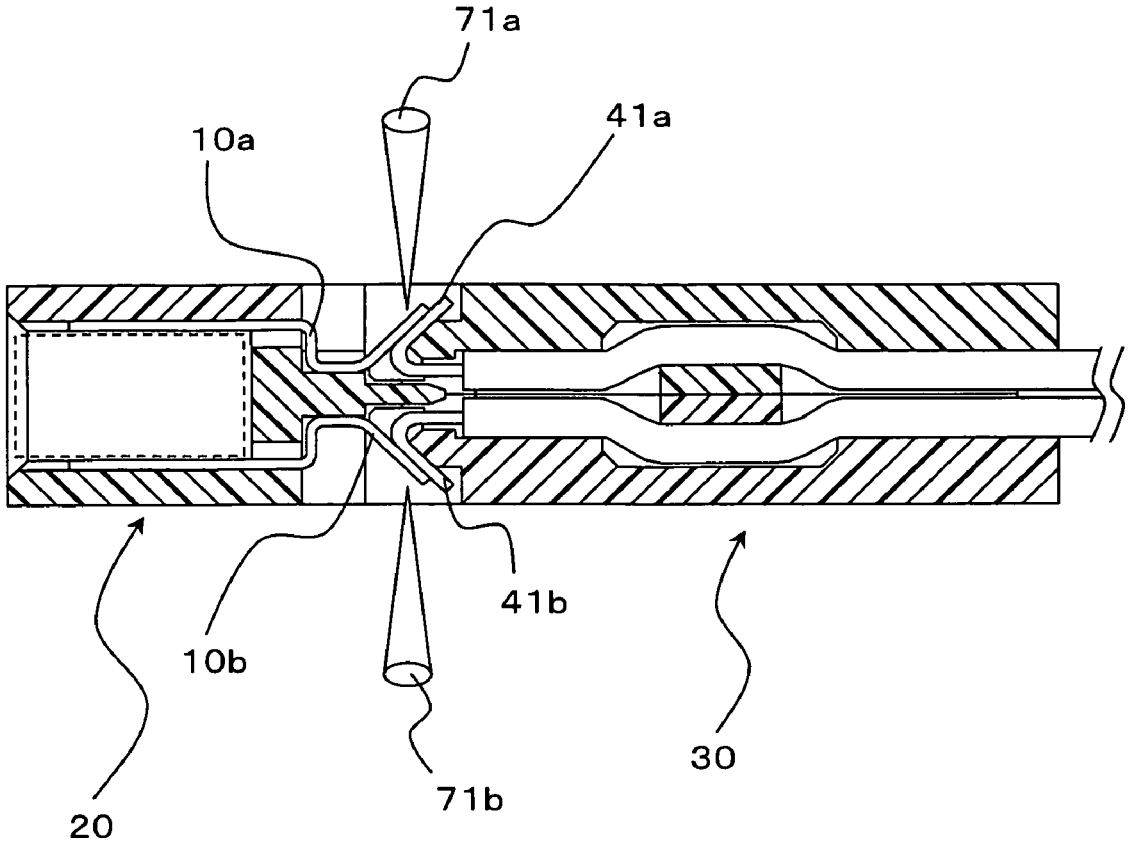

Next referring to FIG. 11, laser beams 71*a* and 71*b* are irradiated to areas where the end portions of the terminals 10*a* and 10*b* are brought into contact with the core wires 41*a* and 41*b* to perform laser welding. Thus, the end portions of the terminals 10*a* and 10*b* are connected to the core wires 41*a* and 41*b* to form connecting portions.

Figure 5:
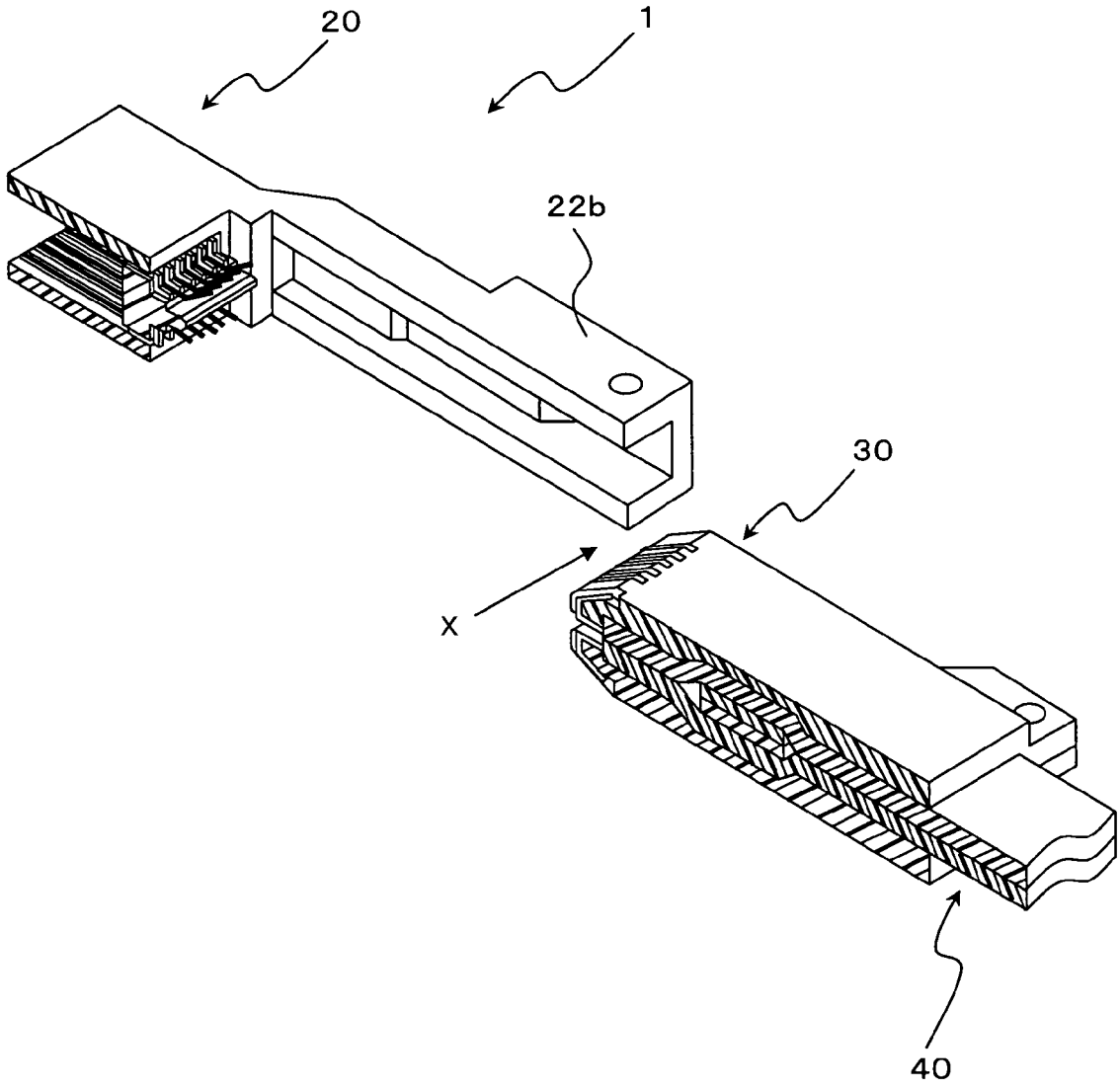
FIG. 5 is an enlarged perspective view, partially in section, of a part of the cable connector illustrated in FIG. 2.

At this time, the cover insulator 30 and the base insulator 20 are moved in a direction X in FIG. 5 in cooperation with oscillation of the laser beams 71*a* and 71*b* so that the end portions of all the terminals 10*a* and 10*b* are connected to the core wires 41*a* and 41*b*.

Herein, the end portions of the terminals 10*a* and 10*b* serve as an elastic member. Accordingly, the additional elastic member or the like for bringing the end portions of the terminals and the core wires into tight contact with each other is not required.

Therefore, irradiation directions of the laser beams 71*a* and 71*b* are not limited.

When the welding is finished, the connecting portions of the end portions of the terminals 10*a* and 10*b* and the core wires 41*a* and 41*b* connected by laser welding are covered with the insulating member 60 in order to assure environment resistance (in order to prevent adhesion of dirt, dust, and the like) (see FIG. 3A).

By the above-mentioned method, the cable connector 1 is connected to the cable 40.

As described above, according to this embodiment, the cable connector 1 comprises the cover insulator 30, the base insulator 20, and the terminals 10*a* and 10*b*. The end portions of the terminals 10*a* and 10*b* are bent and held at the bending angle β. On the other hand, the core wires 41*a* and 41*b* exposed at the end portion of the cable 40 are bent and held at the bending angle α by the grooves 14*a* and 14*b* of the cover insulator 30. The angles α and β satisfy the above-mentioned relationship.

Therefore, the core wires 41*a* and 41*b* are pressed by the end portions of the terminals 10*a* and 10*b* as the elastic member when the cover insulator 30 and the base insulator 20 are coupled to each other. Thus, the end portions of the terminals 10*a* and 10*b* come into tight contact with the core wires 41*a* and 41*b*, respectively.

Accordingly, an additional elastic member or the like for bringing the end portions of the terminals into tight contact with the core wires is not required. Consequently, the cable connector 1 has a simple structure and irradiation directions of the laser beams 71*a* and 71*b* are not limited during laser welding.

Although this invention has been described in conjunction with the exemplary embodiment thereof, this invention may be modified in various other manners within the scope of the appended claims. In the foregoing embodiment, description has been made about the case where this invention is applied to the cable connector for a flat cable. However, this invention is not limited thereto but is also applicable, for example, to cable connectors for cables other than the flat cable.

What is claimed is:

1. A cable connector comprising:

a cover insulator for holding an end portion of a cable;

a base insulator receiving said cover insulator therein; and a terminal held on said base insulator and adapted to be connected to another connector and said cable;

said cover insulator having a holding unit holding the end portion of said cable;

the terminal having an end portion held in a shape adapted to press the end portion of said cable when said cover insulator and said base insulator are coupled to each other;

said cable connector being connected to said cable by coupling said cover insulator and said base insulator to each other and connecting said terminal to the end portion of said cable by laser welding;

said holding unit having an edge with a groove to hold the end portion of said cable so that said cable is bent and held at a bending angle α with respect to a coupling direction of said cover insulator and said base insulator;

the end portion of said terminal being bent and held at a bending angle β with respect to said coupling direction in the state where the end portion of said terminal is not brought into contact with the end portion of said cable; said angles α and β satisfying the relationship given by: $\beta<\pi-\alpha$ (rad).

2. The cable connector as claimed in claim 1, wherein:

said holding unit comprises a groove formed at an end portion of said cover insulator and adapted to receive the end portion of said cable inserted therein;

said groove being inclined at an inclination angle $\pi-\alpha$ (rad) with respect to said coupling direction.

3. The cable connector as claimed in claim 1, further comprising an insulating member covering the end portion of said cable and said terminal.

4. A method of connecting a cable connector and a cable, said cable connector comprising a cover insulator having an edge with a groove to hold an end portion of said cable; a base insulator receiving said cover insulator therein, and a terminal held on said base insulator and adapted to be connected to another connector and said cable; said method comprising:

(a) bending the end portion of said cable;

(b) bending an end portion of said terminal into a shape adapted to press the end portion of said cable when said cover insulator and said base insulator are coupled to each other;

(c) coupling said cover insulator and said base insulator to each other; and (d) connecting the end portion of said cable and the end portion of said terminal by laser welding;

said bending the end portion of said cable by a bending angle α with respect to a coupling direction of said cover insulator and said base insulator;

said bending the end portion of said terminal by a bending angle β with respect to said coupling direction; said angle α and said angle β satisfying the relationship given by: $\beta<\pi-\alpha$ (rad).

5. The method as claimed in claim 4, further comprising:

(e) covering a part connected by laser welding with an insulating member.

* * * * *

UNITED STATES PATENT AND TRADEMARK OFFICE

CERTIFICATE OF CORRECTION

PATENT NO. : 7,658,640 B2
APPLICATION NO. : 12/220048
DATED : February 9, 2010
INVENTOR(S) : Nakazawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

In particular, in Column 8, line 35, (Line 16 of Claim 4) after the word "said", please insert: --(a)--.
In Column 8, line 38, (Line 19 of Claim 4) after the word "said", please insert: --(b)--.

Signed and Sealed this

Ninth Day of November, 2010

David J. Kappos

David J. Kappos
*Director of the United States Patent and Trademark Office*